US006030303A

United States Patent [19]

Wallace, Jr.

[11] Patent Number: 6,030,303

[45] Date of Patent: Feb. 29, 2000

[54] TETHERED BALL CONSTRUCTION

[76] Inventor: Joseph P. Wallace, Jr., 84 Spruce St., P.O. Box 639, Danboro, Pa. 18916

[21] Appl. No.: 09/135,823

[22] Filed: Aug. 18, 1998

[51] Int. Cl.[7] ..... A63B 37/00

[52] U.S. Cl. ..... 473/575; 473/600

[58] Field of Search ..... 473/575, 576, 473/577, 573, 594, 595, 600, 604, 139, 138

[56] References Cited

U.S. PATENT DOCUMENTS

| | | | |
|---|---|---|---|
| 153,794 | 8/1874 | Withers | 473/577 |
| 216,124 | 6/1879 | Adams | 473/575 |
| 300,097 | 6/1884 | McAllister | 473/576 |
| 439,396 | 10/1890 | French | 473/576 |
| 1,236,290 | 8/1917 | Griffin | 473/576 |
| 1,438,573 | 12/1922 | Barkley | 473/575 |
| 3,658,330 | 4/1972 | Maestracci et al. . | |
| 4,616,834 | 10/1986 | Davis . | |
| 4,886,273 | 12/1989 | Unger | 473/577 |
| 5,178,598 | 1/1993 | Finch . | |
| 5,522,757 | 6/1996 | Ostrowski | 473/576 |
| 5,611,540 | 3/1997 | Williams et al. | 473/429 |

*Primary Examiner*—Steven Wong
*Attorney, Agent, or Firm*—Henderson & Sturm LLP

[57] ABSTRACT

A tethered ball construction 10 including an inner spherical core member 30 connected to one end of a tether member 40 wherein the core member 30 is dimensioned to be captively engaged by two hollow hemispherical members 20, 21, adapted to be releasably connected to one another. Differently constructed and dimensioned core members 30 will provide different flight characteristics to the tethered ball construction 10.

10 Claims, 1 Drawing Sheet

TETHERED BALL CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of tethered ball constructions in general, and in particular to a variable weighting system for a tethered ball construction.

2. Description of Related Art

As can be seen by reference to the following U.S. Patent Nos. 3,658,330; 4,616,834; 5,178,598; and 5,611,540, the prior art is replete with myriad and diverse tethered ball constructions.

While all of the aforementioned prior art constructions are more than adequate for the basic purpose and function for which they have been specifically designed, they are uniformly deficient with respect to their failure to provide a simple, efficient, and practical way to change the playing characteristics of a tethered ball so that it is adaptable to a variety of different games which require different flight characteristics and/or weight.

As anyone who has used a conventional tethered ball is all too well aware, each individual ball has a predetermined weight that is considered ideal for its intended purpose, but impractical for other related purposes.

As a consequence of the foregoing situation, there has existed a longstanding need for a new and improved type of tethered ball construction that has a variable weighting system to allow the tethered ball to be used for a variety of different games, and the provision of such a construction is a stated objective of the present invention.

BRIEF SUMMARY OF THE INVENTION

Briefly stated, the tethered ball construction that forms the basis of the present invention comprises in general, an outer spherical unit, an inner spherical unit dimensioned to be received within the outer spherical unit, and a tether unit operatively connected to the spherical core member.

As will be explained in greater detail further on in the specification, the outer spherical unit comprises two hollow hemispherical members which are provided with cooperating fastening elements to join the hemispherical members together into a hollow spherical shape that is dimensioned to receive the inner spherical unit.

In addition, the inner spherical unit is fixedly connected to a tether unit and the outer spherical unit is further provided with a groove dimensioned to accept a portion of the tether unit.

Furthermore, the inner spherical unit can have a variety of physical characteristics such as hollow, resilient, and/or rigid to impart different weights and/or flight characteristics to the finished tethered ball construction.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
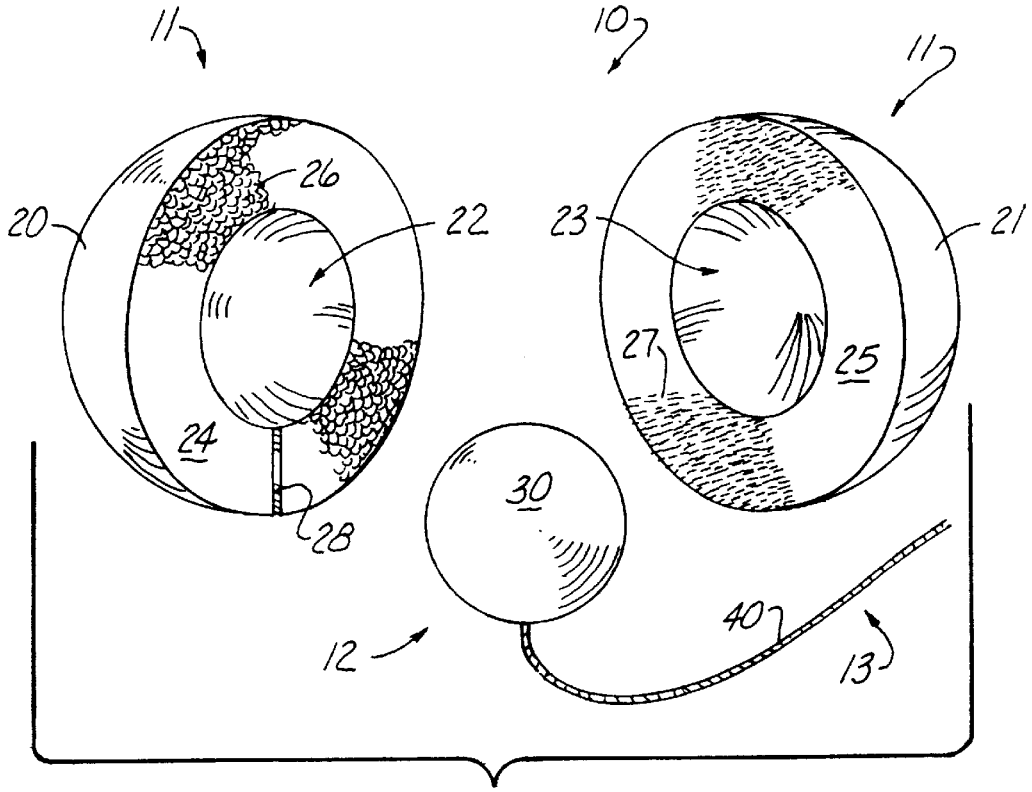
FIG. 1 is an exploded perspective view of the various components that comprise the tethered ball construction.

As can be seen by reference to the drawings, and in particularly to FIG. 1, the tethered ball construction that forms the basis of the present invention is designated generally by the reference number 10. The tethered ball construction 10 comprises in general, an outer spherical unit 11, an inner spherical unit 12, and a tether unit 13. These units will now be described in seriatim fashion.

As shown in FIG. 1, the outer spherical unit 11 comprises two enlarged hollow hemispherical members 20, 21, having central recesses 22, 23 respectively, formed thereon. The flat interior surfaces 24, 25 surrounding the central recesses 22, 23, of each hemispherical member 20, 21 are provided with the cooperating components 26, 27 of a conventional hook and loop fastener to join the hemispherical members 20, 21 into a spherical configuration in a well recognized fashion.

As can also be seen by reference to FIG. 1, at least one of the hemispherical members such as 20 is provided with a groove 28 which extends radially outwardly from the central recess 22 for reasons that will be explained presently.

Still referring to FIG. 1, it can be seen that the inner spherical unit 12 comprises a reduced diameter spherical core member 30 that is dimensioned to be received in the central recesses 22, 23 of each of the hemispherical members 20, 21 of the outer spherical unit 11.

At this juncture, it should be noted that this invention contemplates having the spherical core member 30 of either hollow or solid construction wherein the solid versions, the core member 30 may either be fabricated from resilient or rigid material to provide different weight and/or flight characteristics to the assembled tethered ball construction 10.

Figure 2:
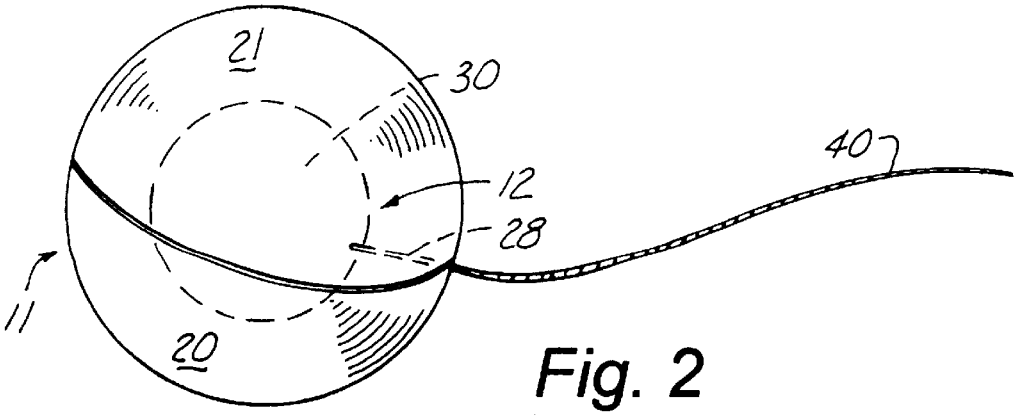
FIG. 2 is a perspective view of the assembled tethered ball construction of this invention.

As shown in FIGS. 1 and 2, the tether unit 13 comprises an elongated tether member 40 that may be fabricated from either resilient or non-resilient material. One end of the tether member 40 is fixedly secured to the spherical core member 30 and dimensioned to be received in the groove 28 in the hemispherical member 20.

It should further be noted that this invention also contemplates having the core member 30 dimensioned to either fit snugly within the central recesses 22, 23 to insure a smooth flight to the tethered ball construction 10 or to fit very loosely within the central recesses 22, 23, to produce an erratic flight characteristic to the tethered ball construction 10.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A tether ball construction comprising:

an inner spherical unit including a reduced diameter spherical core member;

a tether unit including an elongated tether member having one end fixedly secured to the spherical core member;

an outer spherical unit including two enlarged hollow hemispherical members dimensioned to receive said spherical core member and a portion of said tether member; and means for releasably joining the two hemispherical members together to captively surround said spherical core member and a portion of said tether member wherein said core member is solid.

2. The construction as in claim 1 wherein said core member is resilient.

3. The construction as in claim 1 wherein said core member is rigid.

4. The construction as in claim 1 wherein said core member is dimensioned to be loosely received within the two hollow hemispherical members.

5. The construction as in claim 1 wherein at least one of the hemispherical members is provided with a groove dimensioned to receive a portion of the tether member.

6. A tether ball construction comprising:

an inner spherical unit including a reduced diameter spherical core member;

a tether unit including an elongated tether member having one end fixedly secured to the spherical core member;

an outer spherical unit including two enlarged hollow hemispherical members dimensioned to receive said spherical core member and a portion of said tether member; and means for releasably joining the two hemispherical members together to captively surround said spherical core member and a portion of said tether member wherein said core member is dimensioned to be loosely received within the two hollow hemispherical members.

7. The construction as in claim 6 wherein said core member is hollow.

8. The construction as in claim 7 wherein said core member is resilient.

9. The construction as in claim 7 wherein said core member is rigid.

10. The construction as in claim 6 wherein at least one of the hemispherical members is provided with a groove dimensioned to receive a portion of the tether member.

* * * * *